US006336584B1

(12) United States Patent
Roch et al.

(10) Patent No.: US 6,336,584 B1
(45) Date of Patent: Jan. 8, 2002

(54) MULTIPLE USE CARTON BOX

(76) Inventors: François Roch, 12, Notre-Dame, L'Épiphanie, QC (CA), J5X 3C3; Patrick Leblanc, 7755 Jean-Desprez, Anjou, QC (CA), H1K 5C2

( * ) Notice: Subject to any disclaimer, the term of this patent is extended or adjusted under 35 U.S.C. 154(b) by 0 days.

(21) Appl. No.: 09/612,506

(22) Filed: Jul. 7, 2000

(51) Int. Cl.[7] ..... B65D 5/355; B65D 21/08

(52) U.S. Cl. ..... 229/101.2; 229/117.14; 229/149; 229/902

(58) Field of Search ..... 229/101, 101.1, 229/101.2, 117.14, 117.15, 149, 902; 206/541, 549

(56) References Cited

U.S. PATENT DOCUMENTS

| | | | | | |
|---|---|---|---|---|---|
| 2,056,032 | A | * | 9/1936 | Berman | 229/101.1 |
| 2,139,021 | A | * | 12/1938 | Johnson | 229/101.2 |
| 2,355,665 | A | * | 8/1944 | Mabee | 229/101.2 |
| 2,407,415 | A | * | 9/1946 | Graziano | 229/101.1 |
| 3,167,240 | A | * | 1/1965 | Collura et al. | 229/101.2 |
| 3,302,855 | A | * | 2/1967 | Becker | 229/101.1 |
| 3,669,345 | A | * | 6/1972 | Cote | 229/101.2 |
| 3,680,766 | A | * | 8/1972 | Collura et al. | 229/101 |
| 4,230,261 | A | | 10/1980 | Austin | |
| 4,235,364 | A | | 11/1980 | Baker | |
| 4,535,928 | A | | 8/1985 | Capo | |
| 4,782,788 | A | | 11/1988 | Arcand | |
| 4,837,865 | A | | 6/1989 | Roth | |
| 5,060,849 | A | | 10/1991 | King | |
| 5,251,808 | A | * | 10/1993 | Rudd | 229/101.2 |
| 5,344,065 | A | | 9/1994 | Moran | |
| 5,358,172 | A | | 10/1994 | Hollander et al. | |
| 5,542,597 | A | | 8/1996 | Richards | |
| 5,669,493 | A | * | 9/1997 | Focke et al. | 229/101.2 |

FOREIGN PATENT DOCUMENTS

| | | | | |
|---|---|---|---|---|
| DE | 2644334 A1 | * | 4/1977 | 229/101.2 |
| FR | 1183269 A | * | 7/1959 | 229/101.2 |

* cited by examiner

*Primary Examiner*—Gary E. Elkins

(57) ABSTRACT

The present invention is a carton carrying packaging box such as the ones used to carry multiple aluminum cans of soft drinks and the like, that is, after this initial usage, transformed and modified by disposing of certain portions of the carton blank and re-assembled into another type of hand-carried container, such as a lunch box and the like.

20 Claims, 3 Drawing Sheets

MULTIPLE USE CARTON BOX

FIELD OF THE INVENTION

The present invention relates to a multiple use of a carton box, and more specifically to the assembling of a hand-carried lunch box and the like from a previous portable packaging box made out of paperboard or other stiff sheet material such as cartons plastics and the like.

BACKGROUND OF THE INVENTION

Recycled goods are becoming more and more fashionable with the realization of our diminishing natural resources. Various types of papers and cartons are more and more collected by specialized firms to be transformed into reusable materials, especially since the quantities of trees in the forests of this world have been in progressive decline. A cost is however unfortunately associated with this recycling, hence, the possible transformation of a given everyday item into another everyday item before the chemical recycling process is undertaken certainly makes economical sense. Similarly, a non-recyclable product that has a double-usage before being disposed of is equally logical.

Take for those two items or products the traditional packaging box to carry cans of soft drinks or the like in a sizable quantity, such as twelve, or any other quantity, and the small lunch box such as for school kids. Families of our societies with children will often consume and buy both. It could also bring an economical advantage to those families if one item such as the lunch box would come freely and with a simple transformation and assembly from the other usually disposable (or recyclable) one, i.e. from the packaging box. They are relatively the same size, and could be of the same material. Children could furthermore easily get a great sense of pride towards their friends by possibly having differently adorned lunch boxes from time to time, and since they would all come as a bonus to the parents with the soft drinks or the likes, the whole family would be satisfied.

It is already known to provide various items from carton blanks, such as a litter box as disclosed in U.S. Pat. No. 4,782,788 issued on Nov. 8, 1988 to Arcand entitled "Litter box with handle and blank therefor". But this type of prior art does not relate to lunch boxes transformable from previous carrying boxes. Similarly, prior art disclosed in U.S. Pat. No. 4,230,261 issued on Oct. 28, 1980 to Austin entitled "Lunch box carton and a blank for forming the same" relates to lunch boxes transformable from a cardboard blank of flattened configuration but not from a previously used packaging box.

Other prior arts, such as in U.S. Pat. No. 4,535,928 issued on Aug. 20, 1985 to Capo and entitled "Dual purpose carton", U.S. Pat. 4,837,865 issued on Jun. 13, 1989 to Roth and entitled "Sun visor formed from a food and beverage carrier", and U.S. Pat. No. 5,358,172 issued on Oct. 25, 1994 to Hollander et al. and entitled "Transformable carton" all suggest items (caddy for pencils, sun visor, and various containers) transformable initially from a packaging box or the like, but none of the transformed items is a lunch box or an item of the containing-carrier type with a handle and a purpose of bringing a given content outdoors if necessary such as a lunch box.

OBJECTS OF THE INVENTION

It is therefore a general object of the present invention to provide a carton structure that is re-usable and transformable into a hand-carried lunch box of the character described which obviates the above noted disadvantages.

Another object of the present invention is to provide a carton structure that is re-usable and transformable into a containing-carrier type item with a handle and a purpose of bringing a given content outdoors if necessary such as a lunch box.

A further object of the present invention is to provide a carton structure that is re-usable and quickly transformable into a carrying lunch box by simple means preferably not requiring other tools or equipment than a person's hands.

Another object of the present invention is to provide a carton structure that is re-usable and transformable into a virtually free carrying lunch box by providing a mean of combining the easy and economical production of two largely consumed family items.

SUMMARY OF THE INVENTION

The present invention provides a carton structure including main and secondary sides, bottom flaps connected to said secondary and main sides along fold lines, and at least one top flap connected to one of said main sides along fold lines; and at least one of said main sides and each of said secondary sides having perforated and scored lines therein for separating from said carton structure parts of a lunch box and the like, wherein said lunch box includes tapered and main panels each formed integrally therewith from that one of said secondary and main sides respectively of said structure, bottom panels each formed integrally therewith from that one of said bottom flaps of said structure hingedly connected to the respective one of said tapered or main panels, and wherein said lunch box is of polygon shape in cross-section and at least one of said panels having weakening lines for separating a portion thereof to form a handle member for hand-carrying said lunch box therefrom.

Preferably, the lunch box is rectangular in cross-section and at least one of said main panels having weakening lines for separating a portion thereof to form a handle member for hand-carrying said lunch box therefrom.

Preferably, both of said main panels of said lunch box include corresponding male and female portions respectively of a locking member, said locking member releasably locks said lunch box into a closed state for hand carrying purpose.

Alternatively, the main panels of said lunch box include a male portion of a locking member and said tapered panels of said lunch box include a corresponding female portion of said locking member, said locking member releasably locks said lunch box into a closed state for hand carrying purpose.

Preferably, the male portion of said locking member includes at least one ear tab and said female portion includes at least one corresponding slit opening adapted to lockingly receive said ear tab.

Preferably, the lunch box further includes a retaining member formed from a so far unused portion of anyone of said sides or flaps of said structure with weakening lines for separation therefrom, said retaining member being secured internally to said lunch box to provide support for at least one content carried therein.

Alternatively, the carton structure further includes a retaining member properly secured in place over two adjacent of said panels so as to be internal to said lunch box and having perforated and scored lines therein to partially separate therefrom, said retaining member of said lunch box thereby providing support for at least one content carried therein.

Preferably, the handle member includes a folding flap to structurally reinforce itself and to more ergonomically adapt to a user's hand carrying said lunch box.

Alternatively, the one top flap of said structure having perforated and scored lines therein for separating from said carton structure part of said lunch box, wherein one of said main panels of said lunch box is further formed integrally therewith from that one of said main sides of said structure and said top flap hingedly connected thereto.

Preferably, both of said main panels of said lunch box include corresponding male and female portions respectively of a locking member, said locking member releasably locks said lunch box into a closed state for hand carrying purpose.

BRIEF DESCRIPTION OF THE DRAWINGS

In the annexed drawings, like reference characters indicate like elements throughout.

FIG. 9 is partially broken to show a retaining member internally secured to the lunch box.

DETAILED DESCRIPTION OF THE PREFERRED EMBODIMENTS

Figure 1:
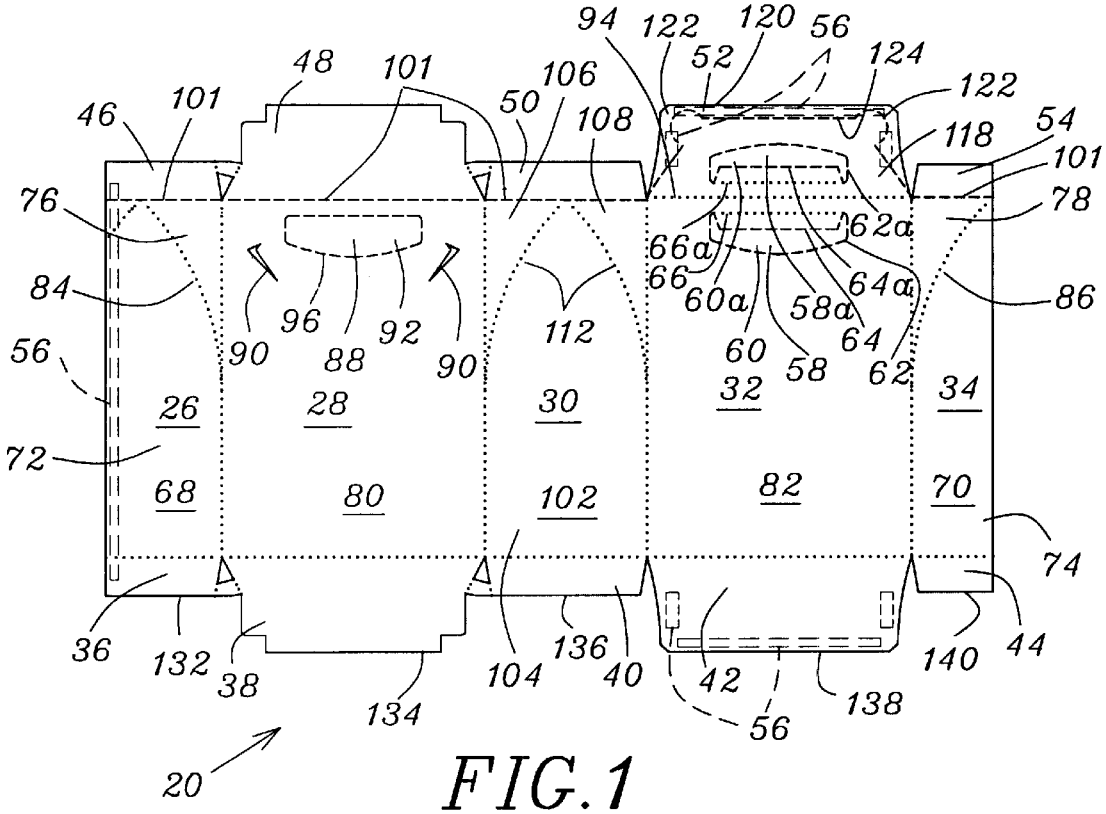
FIG. 1 is a plan view of an embodiment according to a blank of the present invention.
Figure 2:
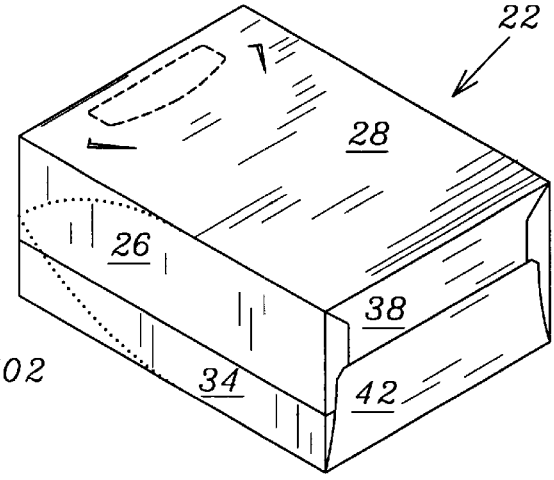
FIG. 2 is a perspective view of the embodiment of FIG. 1 in an assembled condition forming a carton structure for its first use as a packaging box.
Figure 3:
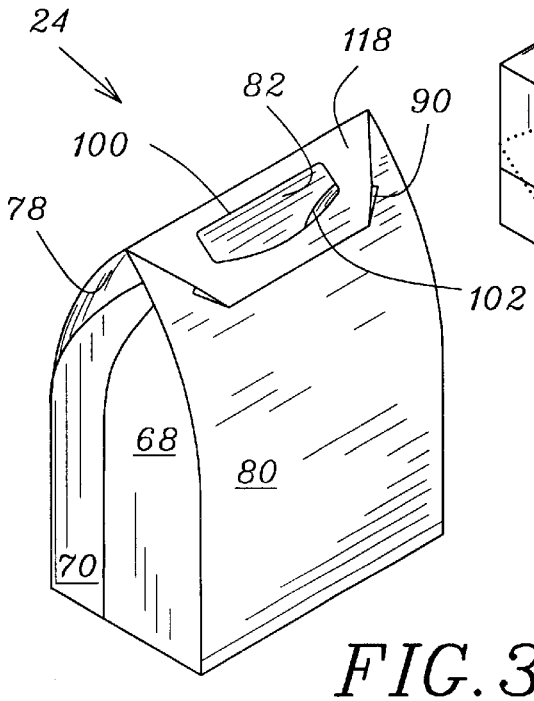
FIG. 3 is a perspective view of the embodiment of FIG. 1 in an transformed condition forming a lunch box for its second use.

Referring to FIGS. 1, 2 and 3, there is shown an embodiment of a generally rectangular blank 20 according to the present invention and comprising all the parts necessary to assemble a polygon in cross-section carton construction structure, preferably a rectangular packaging box 22. Once the packaging box 22 shown in FIG. 2 has been used, it is preferably partially unassembled, essentially at the top, the bottom preferably remaining unchanged. A re-use of the blank 20 is provided by separating specific parts from the latter along specific scored and perforated lines, or weakening lines, as described hereinafter to enable the assembly of a generally rectangular lunch box 24 as shown in FIG. 3, preferably following a first usage as the packaging box 22. The initial useful packaging box 22 is therefore transformed into the useful lunch box 24.

The blank 20 preferably comprises, from left to right on FIG. 1, a generally rectangular secondary narrow side 26, a generally rectangular main side 28, preferably at least three times as wide as the narrow side 26, a generally rectangular secondary narrow side 30 slightly narrower than twice the width of narrow side 26 and of a width generally less than that of the main side 28, a generally rectangular main side 32 of the same width as the main side 28, and a generally rectangular secondary narrow side 34 slightly narrower than the width of the narrow side 26. Each side is hingedly secured to its adjacent side or sides at fold lines shown is dotted lines.

In all the figures, dotted lines identify fold lines while dashed lines identify tear lines required to obtain the lunch box 24.

Generally rectangular bottom flaps 36, 38, 40, 42, and 44 are hingedly secured at their longest edge by fold lines at the short edge of and below their respective side 26, 28, 30, 32, and 34. Bottom flaps 36, 38, 40, 42, and 44 are also essentially of the same width as their respective side. Generally rectangular top flaps 46, 48, 50, 52 and 54 are hingedly secured at their longest edge by fold lines at the other short edge of and above their respective side 26, 28, 30, 32, and 34. Top flaps 46, 48, 50, 52, and 54 are also of essentially the same width as their respective side. Each of the bottom flaps is opposed to its respective top flap about its respective side.

Fastening members, preferably adhesive straps or glue lines 56, are all secured on a same side of the blank 20, on bottom 42 and top 52 flaps, as well as along the external edge of narrow side 26.

For its transformation into the lunch box 24, the packaging box 22 is assembled by folding the sides 26 to 34 (with the first narrow side 26 slightly overlapping the last narrow side 34) and the flaps 36 to 54 along the fold lines and using the glue lines 56 preferably located on the back side of blank 20 of FIG. 1; towards the inside of packaging box 22.

It would be obvious to anyone skilled in the art to modify the blank 20 so as to have, for example, one of narrow sides 26, 34 of the same width as narrow side 30 with the other of the two being small enough to remain a simple flap extending from its respective main side to overlap the first narrow side. Also, that cutout between two adjacent sides could be at any suitable location on the blank 20.

The blank 20 further includes the followings:

Narrow sides 26, 34 comprise a tapered panel 68, 70 respectively having a perforated and scored generally curved fold line 84, 86 respectively separating an inferior portion 72, 74 respectively from a superior portion 76, 78 respectively, when transforming the packaging box 22 into the lunch box 24. Top flaps 46, 54 are respectively being disposed of via scored lines 101.

Main panel 80 formed by main side 28 includes part of a handle member, preferably a horizontally centered opening 88 and a female part of a locking member, preferably two narrow and pre-perforated slit openings 90, or really narrow openings. The opening 88 is substantially rectangular as to fit someone's hand and is obtained by separating a disposable portion 92 from the main panel 80 along perforated line 96. Top flap 48 is being disposed of via scored line 101.

Similarly to narrow sides 26, 34, narrow side 30 comprises a tapered panel 102, having a perforated and scored generally curved fold line 112 separating an inferior portion 104 from two superior portions 106, 108, when transforming the packaging box 22 into the lunch box 24. Top flap 50 is being disposed of via scored line 101.

Main panel 82 comprises main side 32 and part of top flap 52 folding along a perforated line 94. Top flap 52 includes a covering flap portion 118 separated from a disposable portion 120 by a scored line 124. The covering flap 118 is generally trapezoidal and has two ear tabs 122 located at its free side being also a male part of the locking member and adapted to engage corresponding slit openings 90 of main panel 80. Both the main side 32 and the covering flap 118 of main panel 82 include part of the handle member each, preferably a horizontally centered opening 58, **58*a* respectively, and being a mirror image of each other with respect to fold line 94. Each opening 58, 58*a* is substantially rectangular and is obtained by separating a respective disposable portion 60, 60*a* from the main panel 82 along a respective perforated line 62, 62*a*. A respective protection flap 66, 66***a* is secured to the respective upper and lower side of the opening 58, 58*a* by a respective fold line 64, 62*a*. The flaps 66, 66*a* provide a structural reinforcement of the handle member and a more ergonomic support of the latter for a user's hand.

Bottom panels 132, 134, 136, 138, and 140 of lunch box 24 are associated with unaltered bottom flaps 36 to 44 of the packaging box 22 respectively.

By manually separating from the blank 20 along the perforated and scored lines 62, 62*a*, 96, 101 and 124, the disposable portions 60, 60*a*, 92 and 120, and the disposable top flaps 46, 48, 50, and 54, the blank 20 will be left with the following parts: the bottom panels 132, 134, 136, 138, and 140, the tapered panels 68, 70, and 102, and the main panels 80 and 82. Preferably, this separation of the disposable portions is performed without any tool. By folding together the remaining above-mentioned parts along the different fold lines, particularly pushing slightly towards each other the upper parts of inferior portions 72 and 74 (already assembled together from previously formed packaging box 22) and 104, one can easily assemble the lunch box 24. The lunch box 24 can be furthermore closed by optionally engaging the two ear tabs 122 into the two corresponding slit openings 90, operation that brings the three openings 58, 58*a* and 88 aligned to offer a handle 100 to carry the lunch box 24, after flipping covering flap 118 of main panel 82 over main panel 80.

Figure 4:
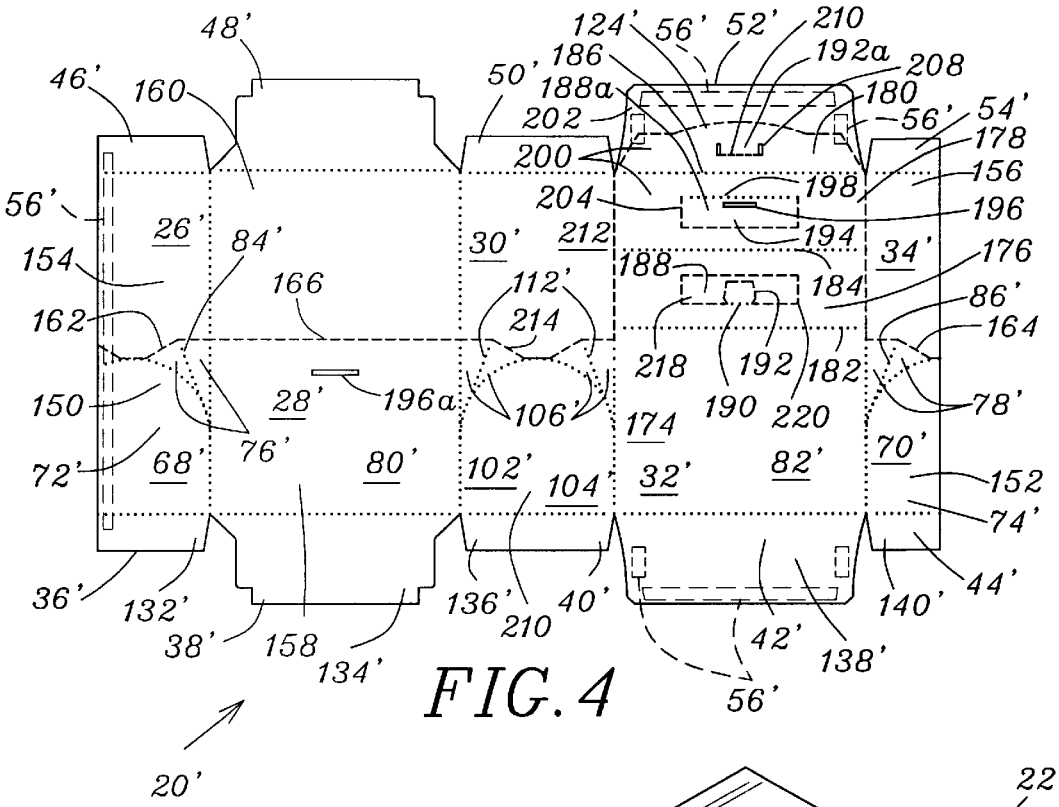
FIGS. 4, 5 and 6 are views similar to FIGS. 1, 2 and 3 respectively showing a second embodiment according to the present invention.
Figure 6:
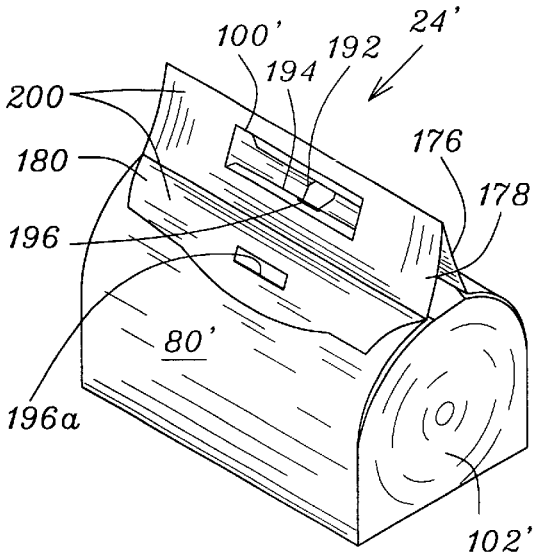
Figure 5:
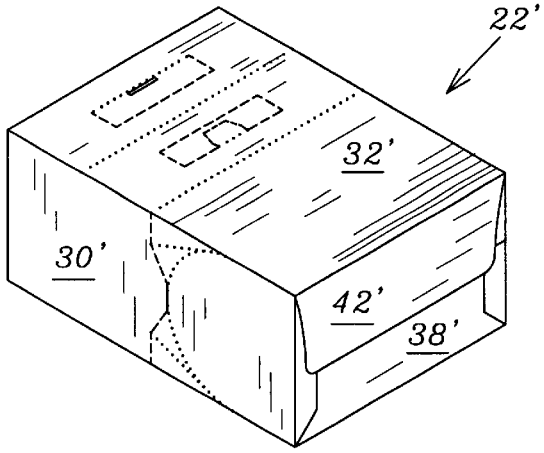

Now referring to FIGS. 4, 5 and 6, there is shown a second embodiment of a generally rectangular blank 20' comprising all the parts necessary to assemble a rectangular packaging box 22'. Similarly to the first embodiment 20, once the packaging box 22' shown in FIG. 5 has been used, it is transformed into a generally rectangular lunch box 24' as shown in FIG. 6.

As for the first embodiment 20, similar numerals used for the second embodiment 20' are identified with a single-quote indicia. The packaging box 22' formed from blank 20' is essentially identical to packaging box 22, with same sides 26' to 34', flaps 36' to 54' and glue lines 56'. Also, the lunch box 24' essentially includes the same side 68', 70' and 102' main 80', 82' and bottom 132' to 140' panels.

For its transformation into the lunch box 24', the blank 20' of FIG. 4 further includes the followings that are essentially different from the first blank 20:

Narrow sides 26', 34' comprise respective generally rectangular lower sections 150, 152 separated from respective disposable upper sections 154, 156 by perforated and scored broken lines 162, 164 respectively. The lower sections 150, 152 forming tapered panels 68', 70' respectively includes respective inferior portions 72', 74' separated from superior portions 76', 78' by perforated and scored fold lines 84', 86' respectively.

Main panel 80' formed by main side 28' comprises a rectangular lower side 158 separated from a disposable upper side 160 by a perforated line 166. The lower side 158 further includes a second female part of a locking member, preferably a pre-perforated essentially horizontal slit opening 196*a*.

Narrow side 30' comprises a generally rectangular lower section 210 separated from a disposable upper section 212 by a perforated and scored broken line 214. The lower section 210 forming second tapered panel 102' includes an inferior portion 104' separated from superior portion 106' by perforated and scored fold lines 112'.

Main panel 82' is formed by main side 32' and part of top flap 52'. Main side 32' includes substantially rectangular lower side 174, first intermediate side 176, and second intermediate side 178 alternatively secured to each adjacent one by fold lines 182 and 184 respectively. The first intermediate side 176 includes part of a handle member, preferably a substantially horizontally centered rectangular, as to fit someone's hand, opening 188. The latter is obtained by separating a disposable portion 218 from the main panel 82' along perforated line 220. On the lower edge of the opening 188, is hingedly secured by a fold line 190 a generally trapezoidal first locking ear tab 192 forming the first male part of the locking member. The second intermediate side 178 includes a corresponding substantially horizontally centered rectangular opening 188*a*. A protecting flap 194 obtained by tearing off perforated U-shaped line 204 is hingedly secured to the upper edge of opening 188*a* by a fold line 198. The flap 194 includes at its approximate geometrical center a preferably pre-perforated horizontal slit opening 196 adapted to lockingly receive the ear tab 192 and forming a first female part of the locking member. Top flap 52' include a substantially trapezoidal protecting extension 180 separated from a disposable portion 202 by a perforated and scored line 124'. The extension 180 is secured to the second intermediate side 178 by fold line 186 and includes the second male part of the locking member, preferably a second locking ear tab 192*a* adapted to engage slit opening 196*a* of main panel 80' and obtained by tearing off perforated line 210 delimited by two pre-perforated vertically elongated lateral holes 208. Second intermediate side 178 and extension 180 form a closing flap 200 to be folded over the first intermediate side 176 and main panel 80' to close the lunch box 24'.

By manually separating from the blank 20' along the perforated and scored lines 124', 162, 164, 166 and 214 (including top flaps 46', 48', 50' and 54') and the disposable portions 202 and 218, the blank 20' will be left with the following parts: the bottom panels 132', 134', 136', 138', and 140', the tapered panels 68', 70' and 102', the main panels 80' and 82'. By folding together the remaining above-mentioned parts along the different fold lines, particularly pushing slightly towards each other the three superior portions 76', 78' and 106', one can easily assemble the lunch box 24'. The lunch box 24' can optionally be furthermore closed by engaging the locking tabs 192, 192*a* into the respective slit openings 196, 196*a*, operation that brings the two openings 188, 188*a* aligned to each other to offer a handle 100' to carry the lunch box 24'.

Figure 7:
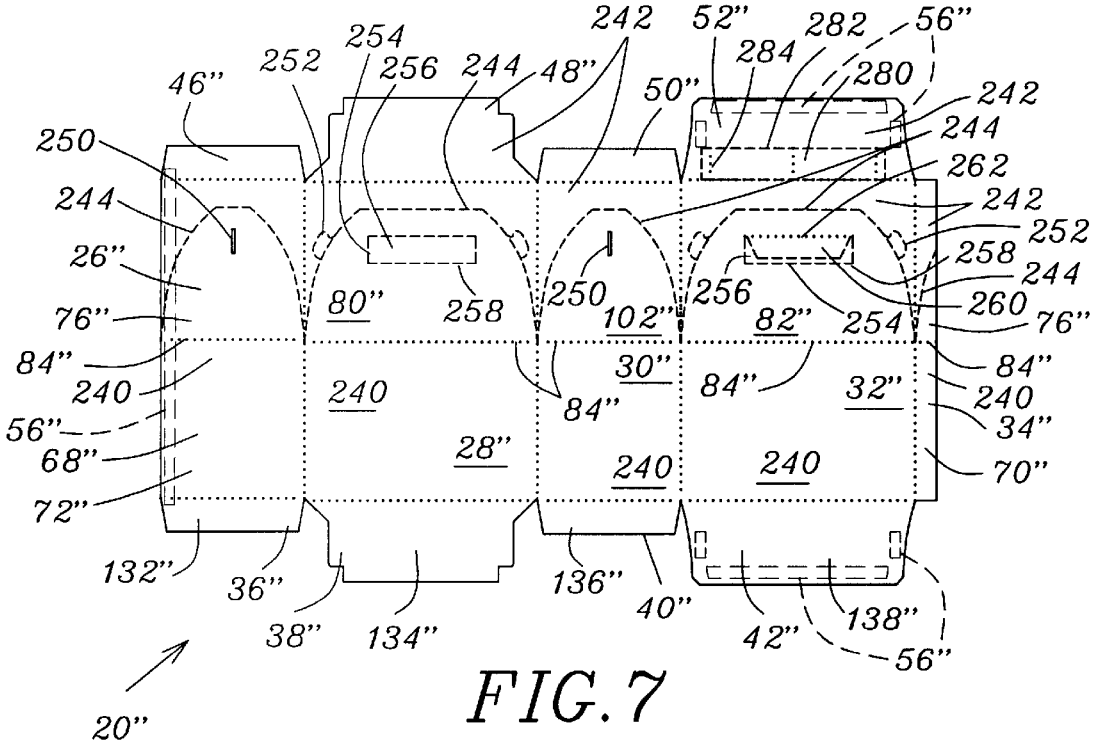
FIGS. 7, 8 and 9 are views similar to FIGS. 1, 2 and 3 respectively showing a third embodiment according to the present invention, also
Figure 9:
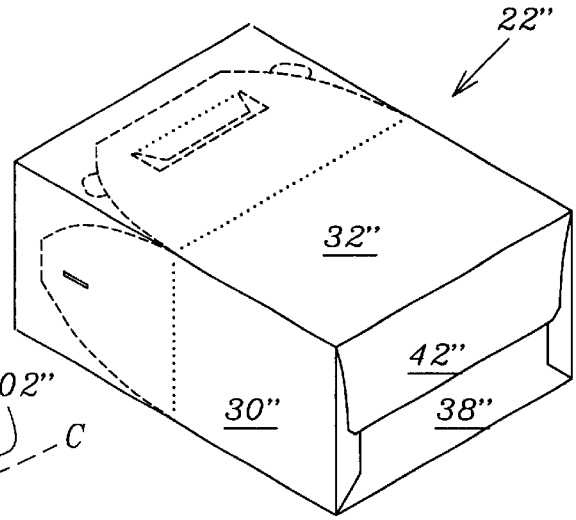
Figure 8:
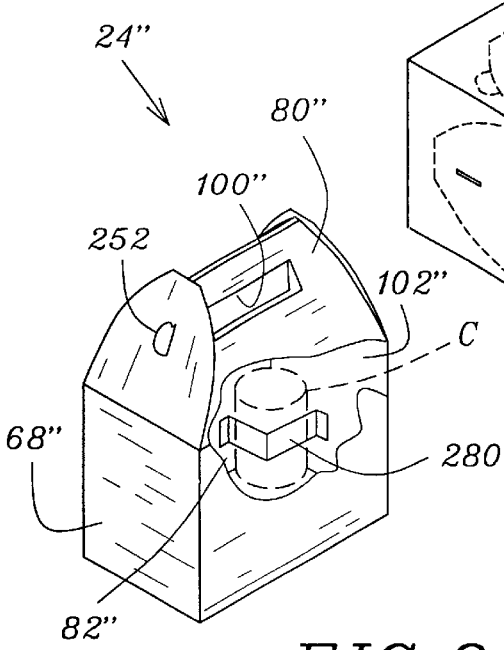

Referring to FIGS. 7, 8 and 9, there is shown a third embodiment a generally rectangular blank 20" comprising all the parts necessary to assemble a rectangular packaging box 22". Similarly to the first embodiment 20, once the packaging box 22" shown in FIG. 8 has been used, it is transformed into a generally rectangular lunch box 24" as shown in FIG. 9.

As for the first embodiment 20, similar numerals used for the third embodiment 20" are identified with a double-quote indicia. The packaging box 22" formed from blank 20" is essentially identical to packaging box 22, with same sides 26" to 34", flaps 36" to 52" and glue lines 56". Also, the lunch box 24" essentially includes the same side 68", 70" and 102" main 80", 82" and bottom 132" to 138" panels.

For its transformation into the lunch box 24", the blank 20" of FIG. 7 further includes the followings that are essentially different from the first two blanks 20, 20':

All narrow sides 26", 30" and 34" and main sides 28" and 32" all comprise respective generally rectangular lower sections 240 separated from respective disposable upper sections 242 by perforated and scored broken lines 244 respectively. The lower sections 240 forming tapered panels 68", 102" and 70" main panels 80" and 82" respectively includes respective inferior portions 72" separated from superior portions 76" by perforated and scored fold lines 84" respectively.

Narrow sides 26" and 30" both include in their respective superior portion 76" a female part of a locking member, preferably an essentially vertical slit 250.

Each of superior portions 76" of main sides 28" and 32" has two ear tabs 252 located at its free side and being also a male part of the locking member and adapted to lockingly engage preferably pre-perforated corresponding slit openings 250 of tapered panels 68" and 102". Similarly to main panel 82, the superior portions 76" of main panels 80" and 82" also includes part of the handle member, preferably a substantially horizontally centered rectangular, as to fit someone's hand, opening 254. The latter is obtained by separating a disposable portion 256 from the main panel 80", 82" along a perforated line 258. Preferably on main panel 82" only, a protection flap 260 is secured to the upper side of the opening 254 by a fold line 262.

By manually separating from the blank 20" along the perforated and scored lines 244 (including top flaps 46", 48", 50" and 52") and the disposable portions 256, the blank 20" will be left with the following parts: the bottom panels 132", 134", 136" and 138", the tapered panels 68", 70" and 102", the main panels 80" and 82". By folding together the remaining above-mentioned parts along the different fold lines, particularly by pushing the corresponding handle openings 254 against each other and aligned, one can easily assemble the lunch box 24". The lunch box 24" can optionally be furthermore closed by engaging the locking ear tabs 252 into the respective slits 250, operation that keeps the two openings 254 aligned to each other to offer a handle 100" to carry the lunch box 24".

Furthermore, it would be obvious to anyone skilled in the art to replace the scored lines used to detach disposable portions from the blank 20, 20', 20", that could eventually weaken for the latter too much, by marked lines that would therefore require use of a tool such as scissors or the like.

Optionally, a retaining member, preferably a generally elongated retainer tab 280 (as shown in FIGS. 7 and 9), could be provided on any side 26" to 34" or flap 36" to 54" (flap 52" shown in the present case on FIG. 7), or any combination thereof, with available space. The tab 280 is detached from flap 52" using perforated and scored line 282 and preferably includes a plurality of fold lines 284. The latter are used to properly install the retainer tab 280 inside the lunch box 24" on two adjacent panels. The tab 280 is preferably used to firmly hold any content, preferably a soft drink can C and the like, inside the lunch box 24".

Alternatively, the retainer tab 280, with the same perforated lines 284, could be pre-secured, preferably pre-glued, in proper position onto the back side of the blank 20" and sized to retain a standard size soft drink can C and the like.

Although preferably rectangular packaging boxes and corresponding lunch boxes are described herein, it would be obvious to anyone skilled in the art to similarly transform a hexagon or octagon in cross-section packaging box into a corresponding hexagon or octagon in cross-section lunch box respectively.

Preferably, the packaging box 22 is a standard box to carry aluminum cans of soft drinks, a large cereal box or the like, made out of rigid paperboard, carton or plastic material.

Although embodiments have been described herein with some particularity and details, many modifications and variations of the preferred embodiments are possible without deviating from the scope of the present invention.

We claim:

1. A carton structure including main and secondary sides, bottom flaps connected to said secondary and main sides along fold lines, and at least one top flap connected to one of said main sides along fold lines; and at least one of said main sides and each of said secondary sides having perforated and scored lines therein for separating from said carton structure parts of a lunch box and the like, wherein said lunch box includes tapered and main panels each formed integrally therewith from that one of said secondary and main sides respectively of said structure, bottom panels each formed integrally therewith from that one of said bottom flaps of said structure hingedly connected to the respective one of said tapered or main panels, and wherein said lunch box is of polygon shape in cross-section and at least one of said panels having weakening lines for separating a portion thereof to form a handle member for hand-carrying said lunch box therefrom.

2. A carton structure as defined in claim 1, wherein said lunch box is rectangular in cross-section and at least one of said main panels having weakening lines for separating a portion thereof to form a handle member for hand-carrying said lunch box therefrom.

3. A carton structure as defined in claim 1, wherein said one top flap of said structure having perforated and scored lines therein for separating from said carton structure part of said lunch box, wherein one of said main panels of said lunch box is further formed integrally therewith from that one of said main sides of said structure and said top flap hingedly connected thereto.

4. A carton structure as defined in claim 3, wherein said lunch box is rectangular in cross-section and at least one of said main panels having weakening lines for separating a portion thereof to form a handle member for hand-carrying said lunch box therefrom.

5. A carton structure as defined in claim 2, wherein both of said main panels of said lunch box include corresponding male and female portions respectively of a locking member, said locking member releasably locks said lunch box into a closed state for hand carrying purpose.

6. A carton structure as defined in claim 5, wherein said male portion of said locking member includes at least one ear tab and said female portion includes at least one corresponding slit opening adapted to lockingly receive said ear tab.

7. A carton structure as defined in claim 5, wherein said lunch box further includes a retaining member formed from a so far unused portion of anyone of said sides or flaps of said structure with weakening lines for separation therefrom, said retaining member being secured internally to said lunch box to provide support for at least one content carried therein.

8. A carton structure as defined in claim 5, further including a retaining member properly secured in place over two adjacent of said panels so as to be internal to said lunch box and having perforated and scored lines therein to partially separate therefrom, said retaining member of said lunch box thereby providing support for at least one content carried therein.

9. A carton structure as defined in claim 1, wherein said main panels of said lunch box include a male portion of a locking member and said tapered panels of said lunch box include a corresponding female portion of said locking member, said locking member releasably locks said lunch box into a closed state for hand carrying purpose.

10. A carton structure as defined in claim 9, wherein said male portion of said locking member includes at least one ear tab and said female portion includes at least one corresponding slit opening adapted to lockingly receive said ear tab.

11. A carton structure as defined in claim 9, wherein said lunch box further includes a retaining member formed from a so far unused portion of anyone of said sides or flaps of said structure with weakening lines for separation therefrom, said retaining member being secured internally to said lunch box to provide support for at least one content carried therein.

12. A carton structure as defined in claim 9, further including a retaining member properly secured in place over two adjacent of said panels so as to be internal to said lunch box and having perforated and scored lines therein to partially separate therefrom, said retaining member of said lunch box thereby providing support for at least one content carried therein.

13. A carton structure as defined in claim 4, wherein both of said main panels of said lunch box include corresponding male and female portions respectively of a locking member, said locking member releasably locks said lunch box into a closed state for hand carrying purpose.

14. A carton structure as defined in claim 13, wherein said male portion of said locking member includes at least one ear tab and said female portion includes at least one corresponding slit opening adapted to lockingly receive said ear tab.

15. A carton structure as defined in claim 13, wherein said lunch box further includes a retaining member formed from a so far unused portion of anyone of said sides or flaps of said structure with weakening lines for separation therefrom, said retaining member being secured internally to said lunch box to provide support for at least one content carried therein.

16. A carton structure as defined in claim 13, further including a retaining member properly secured in place over two adjacent of said panels so as to be internal to said lunch box and having perforated and scored lines therein to partially separate therefrom, said retaining member of said lunch box thereby providing support for at least one content carried therein.

17. A carton structure as defined in claim 1, wherein said handle member includes a folding flap to structurally reinforce itself and to more ergonomically adapt to a user's hand carrying said lunch box.

18. A carton structure as defined in claim 3, wherein said handle member includes a folding flap to structurally reinforce itself and to more ergonomically adapt to a user's hand carrying said lunch box.

19. A carton structure as defined in claim 6, wherein said handle member includes a folding flap to structurally reinforce itself and to more ergonomically adapt to a user's hand carrying said lunch box.

20. A carton structure as defined in claim 13, wherein said handle member includes a folding flap to structurally reinforce itself and to more ergonomically adapt to a user's hand carrying said lunch box.

* * * * *